United States Patent [19]

Hou

[11] 3,942,980

[45] Mar. 9, 1976

[54] ION MODULATOR DEVICE AND METHOD OF USING IN POSITIVE AND NEGATIVE MODES

[75] Inventor: Shou Ling Hou, Barrington, Ill.

[73] Assignee: Addressograph-Multigraph Corporation, Cleveland, Ohio

[22] Filed: May 2, 1975

[21] Appl. No.: 574,044

Related U.S. Application Data

[63] Continuation-in-part of Ser. No. 488,936, July 16, 1974, abandoned.

[52] U.S. Cl. ..... 96/1.5; 96/1 R; 96/1.8; 355/3 R; 346/74 ES

[51] Int. Cl.[2] ..... G03G 5/04; G03G 13/22

[58] Field of Search ..... 96/1 R, 1.5, 1.8; 355/35 C; 346/74 EP

[56] References Cited

UNITED STATES PATENTS

| | | | |
|---|---|---|---|
| 3,645,614 | 2/1972 | McFarlane et al. | 355/35 C |
| 3,647,291 | 3/1972 | Pressman et al. | 355/35 C |
| 3,680,954 | 8/1972 | Frank | 355/35 C |
| 3,694,200 | 9/1972 | Pressman | 96/1 R |
| 3,713,734 | 1/1973 | Crane et al. | 96/1 R X |
| 3,737,222 | 6/1973 | Briggs | 96/1 R X |
| 3,773,417 | 11/1973 | Pressman et al. | 355/35 C |
| 3,796,490 | 3/1974 | Pressman | 96/1 R X |
| 3,797,926 | 3/1974 | Fotland et al. | 96/1 R X |
| 3,824,010 | 7/1974 | Pressman | 96/1 R X |

*Primary Examiner*—Roland E. Martin, Jr.
*Attorney, Agent, or Firm*—Michael A. Kondzella

[57] ABSTRACT

An ion modulator of improved sensitivity and capable of producing copies of excellent quality is provided in the form of a conductive metal screen which is coated with a photoconductor or insulator and having a supplementary electrode forming an integral part thereof. The supplementary electrode functions to provide a positive or negative bias potential resulting in a larger transmission coefficient, better gray scale, improved light sensitivity, and the ability to operate in both positive and negative modes.

6 Claims, 7 Drawing Figures

ION MODULATOR DEVICE AND METHOD OF USING IN POSITIVE AND NEGATIVE MODES

BACKGROUND OF THE INVENTION

This application is a continuation-in-part of copending application Ser. No. 488,936, filed July 16, 1974.

This invention relates to electrophotographic processes and apparatus. In one of its more particular aspects this invention relates to a multi-layered ion modulator and its use in an electrophotographic process which is capable of operating in both the positive and negative modes.

Electrophotographic reproduction techniques for making copies of graphic originals using photoconductive media are well known. Such processes generally call for applying a blanket electrostatic charge to a photoconductor in the dark and then exposing the charged photoconductor to a pattern of light and shadow created by directing electromagnetic radiation onto a graphic original. The light-struck areas of the photoconductor are discharged leaving behind a latent electrostatic image corresponding to the original. A developed image is produced by applying an electroscopic powder to the latent electrostatic image and then fixing the image or transferring and fixing onto a suitable receiving medium such as plain paper.

This technique has been extended to foraminated structures which are formed by applying a photoconductive layer to a conductive screen or similar apertured structure. Such structures function as ion modulators selectively passing a stream of ions through the apertures of the screen in a pattern corresponding to the graphic orignal to be reproduced.

The ion modulators which have been developed heretofore and are known in the prior art fall into several distinct classes:

The first is a two-layered screen or grid construction which is formed by applying a photoconductive layer onto an apertured metallic substrate, as disclosed in U.S. Pat. No. 3,220,324 to Christopher Snelling. Such a structure is capable of accepting an electrostatic charge corresponding to a pattern of light and shadow created by electromagnetic radiation directed onto a graphic original. The operation and construction of such a device requires that the projection of ions through the screen occur simultaneously with the projection of the pattern of light and shadow. The simultaneity requirement is occasioned by the inability of such a system to retain or have any "memory" in terms of the charge pattern imparted to the structure.

A three layer modulator is disclosed in co-pending applications Ser. Nos. 423,883 and 423,884 filed Dec. 12, 1973, of John D. Blades and Jerome E. Jackson assigned to the same assignee as this application. The three layered modulator described in the above mentioned applications possesses a memory which makes it unnecessary to simultaneously image and project ions through the modulator.

A second group of photoconductive screens has been adapted for use with charged material particles such as charged electroscopic powders but not gas ions. Typical of such screens are those disclosed in U.S. Pat. Nos. 3,694,200 to Gerald L. Pressman and 3,713,734 to Hewitt D. Crane, Gerald L. Pressman and George J. Eilers. Such structures suffer from the deficiency that charged particles accumulate in those areas of structure which attract the particles. Ultimately, it is required that the screen be cleaned to physically remove the particles in order that the screen may be reused.

The use of such screens with ions rather than charged electroscopic powders is disclosed in U.S. Pat. No. 3,645,614 to Samuel B. McFarlane, Jr., Joseph Burdige and Norman E. Alexander. However, the process involved in the use of these screens requires a multiplicity of steps and results in a reversal image.

While the prior art modulators have advanced the electrophotographic art there are disadvantages which need to be overcome in order to provide an ion modulator system which is sufficiently sensitive so that copies can be made quickly and with a minimum of exposure to light. It is also desirable to provide copies which have a quality which is homogeneous throughout and in which the amount of background is reduced to a minimum.

OBJECTS

It is accordingly an object of this invention to provide improved electrophotographic apparatus and processes.

It is another object of this invention to provide improved ion modulators which are capable of functioning in both the positive and negative modes.

It is another object of this invention to provide ion modulators having an improved light sensitivity.

Another object of this invention is to provide ion modulators having an enhanced ion transmission.

Yet another object of this invention is to provide processes and apparatus for producing copies in which the copy quality is homogeneous and the background is minimal.

Other objects and advantages of this invention will become apparent in the course of the following detailed disclosure and description.

SUMMARY OF THE INVENTION

It has been found that applying a bias potential to an ion modulator consisting of a conductive screen or grid which is coated with a photoconductor or insulator by means of an auxiliary or supplementary electrode forming an integral part of the ion modulator results in a versatile modulator which is capable of functioning in both positive and negative modes. The modulator is characterized by possessing a high order of light sensitivity and enhanced ion transmission. Copies exhibiting a homogeneous copy quality and essentially free of background can be prepared using such modulator.

THE DRAWING

DESCRIPTION OF THE PREFERRED EMBODIMENTS

Figure 1:
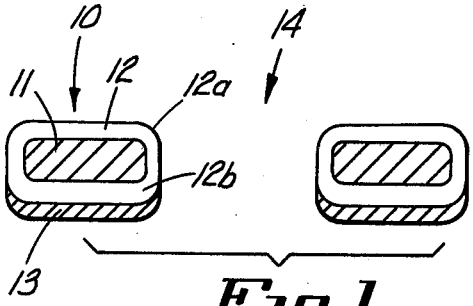
FIG. 1 is a diagrammatic cross-sectional view of one embodiment of a portion of an ion modulator according to this invention.

Referring to FIG. 1 there is shown in cross-section a diagrammatic view of an ion modulator according to this invention. The modulator 10 consists of conductor 11 coated on all sides by insulating material 12 on one side of which is positioned conductive supplementary electrode 13. The apertures in the ion modulator are generally indicated by the numeral 14. Conductor 11 can be a nickel or copper screen which is produced by electroforming or can be any metallic grid which is produced by means of photoresist techniques or can be produced by any other conventional method of producing an apertured configuration in a metallic substrate. For purposes of convenience the term "screen" will be used hereinafter to refer to such apertured conductor. The metal is preferably less than about 1 mil in thickness.

Insulating material 12 can be any insulator. However, at least the surface layer 12a must be photoconductive as will be described in greater detail below. Any polymeric insulating composition such as polystyrene or a polyester can be used as insulator **12*b* or can be prepared from silicon dioxide or other inorganic insulating material. The insulating layer is preferably on the order of from 2 to 10 microns in thickness and may be deposited upon the metallic substrate 11** by means of any suitable coating technique.

At least that part of insulator 12 which is exposed to the imaging light pattern should be a photoconductor, that is, should exhibit properties of increased conduction in the presence of light. A wide variety of photoconductors are known including inorganic materials like selenium or zinc oxide and various organic photoconductors such as polyvinylcarbazole, the polyvinylbenzocarbazoles described in U.S. Pat. No. 3,751,246 to Helen C. Printy and Evan S. Baltazzi and polyvinyliodobenzocarbazoles described in U.S. Pat. No. 3,764,316 to Earl E. Dailey, Jerry Barton, Ralph L. Minnis and Evan S. Baltazzi. Other organic photoconductors which may be used include monomeric photoconductors which require dispersion in a resin binder. These photoconductors include the benzofluorenes and dibenzofluorenes described in U.S. Pat. No. 3,615,412 to William J. Hessel and the cumulenes described in U.S. Pat. No. 3,674,473 to Robert G. Blanchette. In many instances the organic photoconductors mentioned above may be used with a suitable sensitizer to extend the spectral range of the photoconductor. Dyes may be used for this purpose. Another class of materials which are widely used are the pi-acids. Representative of these compounds are the oxazolones and butenolide derivatives of fluorenone described in U.S. Pat. No. 3,556,785 to Evan S. Baltazzi, the dicyanomethylene substituted fluorenes described in U.S. Pat. No. 3,752,668 to Evan S. Baltazzi, and the bianthrones described in U.S. Pat. No. 3,615,411 to William J. Hessel.

Electrode 13 may be formulated by means of use of an aluminum film or a nickel, silver or gold film which may be incorporated upon the surface of insulator 12. If insulator 12 is not comprised of a photoconductor in its entirety then electrode 13 is applied to that part of insulator 12 which is opposite from the photoconductive part **12*a*, namely 12*b***. The electrodes are applied as a thin metal film which may be about 100–1,000 Angstrom units in thickness.

The particular embodiment of the modulators of this invention shown in FIG. 1 is subject to a shielding effect such that $\eta$ the efficiency of biasing by means of the supplementary electrode 13 is less than 1. That is, the dipole potential produced by biasing is not exactly equal to the bias potential but is only a fraction thereof, the fraction being represented by the efficiency, $\eta$.

Figure 2:
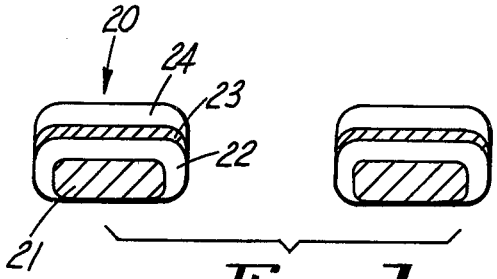
FIG. 2 is a diagrammatic cross-sectional view of another embodiment.

In contrast to the above described situation wherein the efficiency is less than 1 an efficiency close to unity is realized by means of the configuration is of the modulator shown in FIG. 2, in which modulator 20 is comprised of conductor 21 upon which is deposited insulator 22, which may be photoconductor with supplementary electrode 23 being evaporated thereon and photoconductor 24 overlying electrode 23. The composition and dimensions of the various layers is approximately the same as described with respect to FIG. 1. However, the shielding effect due to coating the metallic substrate with an insulator is greatly reduced in this embodiment making it possible to realize an efficiency of near unity whereby the bias potential is equal to the dipole potential produced by means of the bias.

Figure 3:
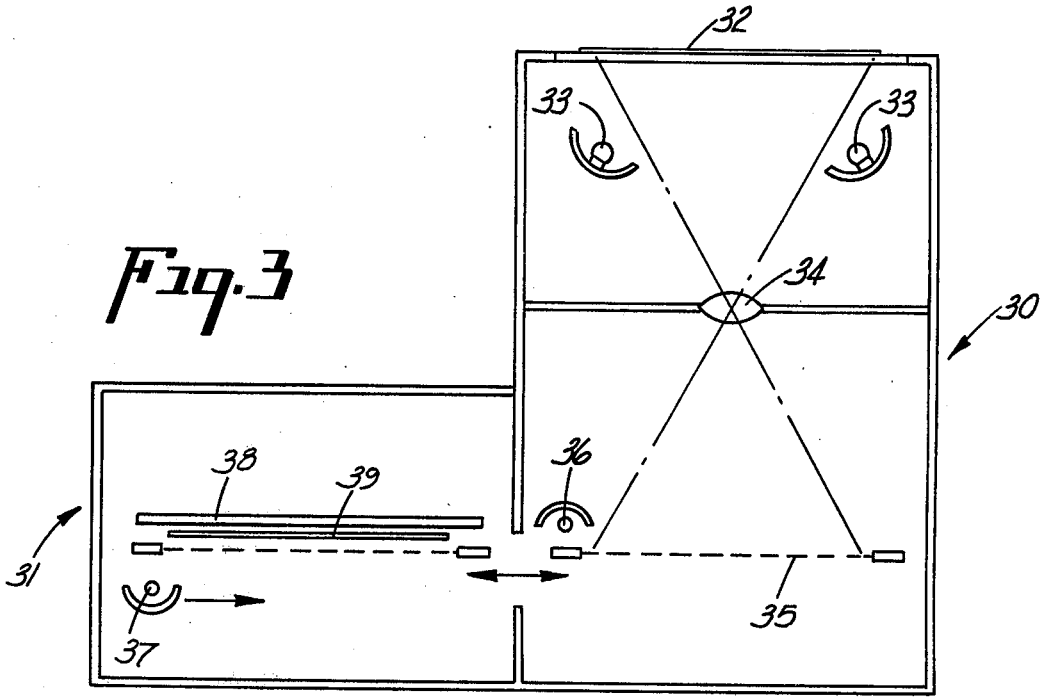
FIG. 3 is a diagrammatic view of a machine configuration suitable for use in this invention.

A machine in which the ion modulator of this invention can be used is shown in FIG. 3. The machine generally consists of optical chamber 30 and projection chamber 31. Original 32 to be copied is imaged in optical chamber 30 by means of lamps 33 and lens 34 upon ion modulator 35 which has been charged by means of charging corona 36.

Ion modulator 35 is then moved into projection chamber 31 where an ion stream from projection corona 37 is caused to impinge thereon.

In this position ion modulator 35 is backed up by high voltage plate 38. Dielectric surface 39 interposed between modulator 35 and high voltage plate 38 receives a charge pattern corresponding to the ions transmitted through ion modulatar 35 as will be explained in detail below.

The operation of the ion modulators of this invention will be first illustrated with reference to the embodiment of FIG. 2 which is preferred because of its high efficiency, as explained above. However, it is to be understood that the embodiment of FIG. 1 can be similarly used.

Figure 4:
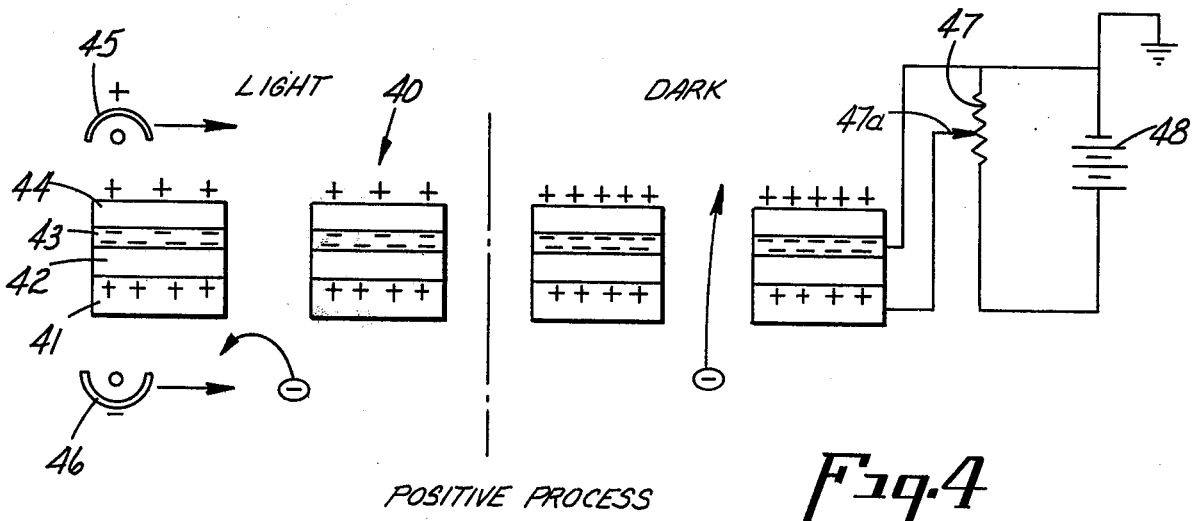
FIG. 4 is a diagrammatic view of a charged and imaged ion modulator showing the distribution of charges and the projection of ions in accordance with one embodiment of this invention.

Referring now to FIG. 4 there is shown an ion modulator system which can be used in a positive mode to produce a positive copy from a positive original. Ion modulator 40 includes metallic screen 41, photoconductor or insulator 42, supplementary electrode 43 and photoconductor 44. Positive corona 45 is positioned above ion modulator 40 and negative corona 46 is positioned below ion modulator 40. The supplementary electrode 43 is shown grounded in FIG. 4. One should not conclude this a necessity, however, because either screen 41 or supplementary electrode 43 can be chosen as ground.

The process steps which result in producing a latent electostatic image upon a dielectric surface such as dielectric paper using the ion modulator of FIG. 4 include the following. First, applying a positive bias, that is, a positive potential difference between screen 41 and supplementary electrode 43, to the ion modulator and precharging with a positive corona. The positive bias assures a larger acceptance voltage. An increase of 40% in acceptance voltage has been obtained if a positive bias of +60 volts is used. Second, imaging to obtain appropriate partial light discharge. Third, projecting a negative corona with a positive bias. Following the production of a latent electrostatic image, toning and transfer if desired is accomplished in the conventional manner.

As shown in FIG. 4 these steps produce a positive charge on the surface of the photoconductor of a sufficient magnitude to permit negative ions produced by the negative corona to pass through the ion modulator in the areas of the modulator corresponding to the dark areas of the image being reproduced. In the light areas the positive charge upon the surface of the photoconductor is insufficient to attract the negative ions through the apertures of the ion modulator and these charges are deflected before passing through the modulator. Thus, in the areas of the ion modulator corresponding to the dark areas of the image being reproduced a negative charge will be impressed upon a dielectric surface in the path of the ions passing through the modulator and in the areas of the modulator corresponding to the light areas of the image no negative charge upon the dielectric will result.

A circuit which can be used to apply the appropriate bias potential to ion modulator 40 is shown schematically in FIG. 4. This circuit includes variable resistor 47 and battery 48. The negative pole of battery 48 is connected to electrode 43, to one end of variable resistor 47 and to ground. The positive pole of battery 48 is connected to the other end of variable resistor 47. Screen 41 is connected to wiper 47a of variable resistor 47 in order that the difference in potential between screen 41 and electrode 43 may be varied if desired.

In this embodiment the bias potential applied to modulator 40 during charging may be a potential in the range of about from 50 volts to 100 volts. The positive corona used for precharging should be a potential in the range of about from 4,000 volts to 15,000 volts. The negative corona used for producing the stream of ions which is projected upon ion modulator 40 can be produced using a potential in the range of about from 4,000 volts to 15,000 volts and the positive bias applied during projection of the negative ions upon the modulator should be on the order of about from 1 volt to 30 volts.

If positive ions are projected instead of negative ions the modulator will operate in the negative mode in which a negative copy is produced from a positive original.

Figure 5:
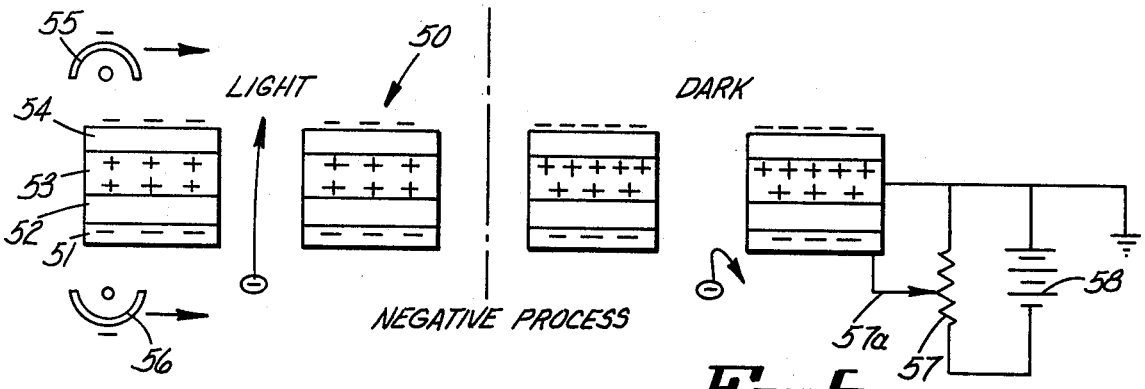
FIG. 5 is a diagrammatic view of another embodiment thereof.

FIG. 5 illustrates another embodiment in which the modulator construction of FIG. 1 is used in a negative mode process.

Ion modulator 50 includes supplementary electrode 51, photoconductor or insulator 52, metallic screen 53 and photoconductor 54. Negative charging corona 55 is positioned above ion modulator 50. A negative bias, that is, a negative potential difference between supplementary electrode 51 and screen 53, may be applied to modulator 50 by means of variable resistor 57 and battery 58. The bias potential can be varied by means of wiper 57*a* of variable resistor 57. Either screen 53 or supplementary electrode 51 may be ground.

The process steps involved in operating the ion modulator in a negative mode include first applying a high negative bias to ion modulator 50 and precharging with a negative corona by means of charging corona 55; second, imaging to obtain appropriate partial light discharge of the photoconductor; and third, projecting a negative corona from corona 56 with application of a reduced negative bias.

As shown in FIG. 5 negative ions projected from corona 56 travel through the apertures in ion modulator 50 in the light areas due to the reduced negative charge on photoconductive surface 54 of ion modulator 50. In the dark areas the negative ions are deflected to the high negative potential on photoconductor 54.

In operation the projection of negative ions upon ion modulator 50 results in the formation of a latent electrostatic image upon a dielectric surface placed in the path of the ions projected through modulator 50. The resulting latent electrostatic image can thereafter be toned and fixed or transferred to a suitable medium such as plain paper in accordance with well known procedures in this art.

If positive ions are projected instead of negative ions, this modulator will operate in the positive mode.

It should be noted that the bias potential and the electrostatic charge used for precharging the ion modulator are of the same polarity in all the embodiments described above, because the supplementary electrode 43 in FIG. 4 and the screen 53 in FIG. 5 were chosen to be ground.

The ion modulators of this invention are effective to produce copies which are of excellent quality having a homogeneous density throughout the copy and being essentially free of undesired background. The way in which this is accomplished will become clear from the following explanation of the physical principles which are utilized in controlling the bias potential applied to the ion modulator.

Figure 6:
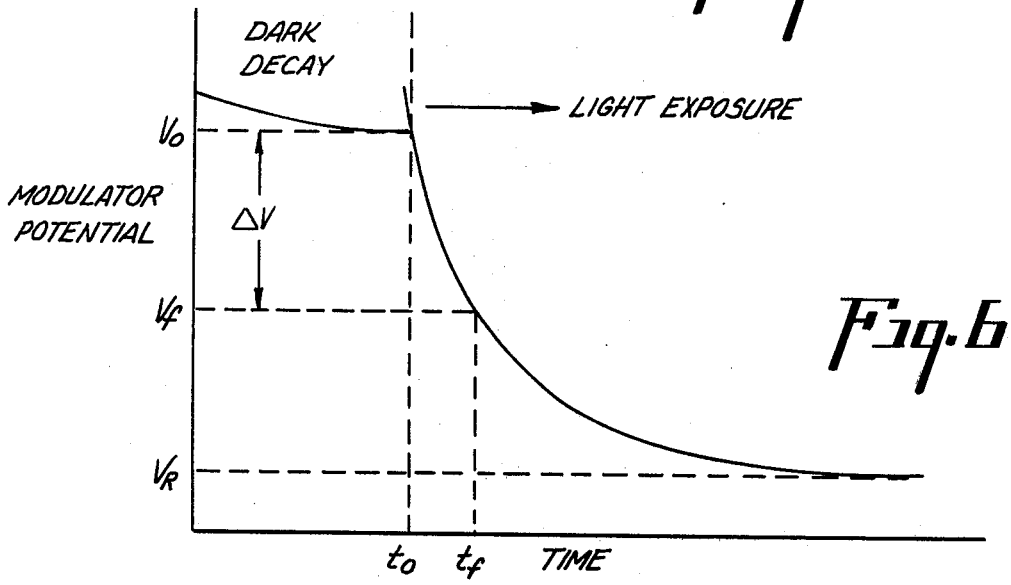
FIG. 6 is a light decay curve for a typical photoconductor.

It is known that the electrical potential applied to a photoconductor will decay in the dark from the maximum level to some lesser level of potential, $V_o$. This phenomenon is generally referred to as dark decay. Then upon exposure of the photoconductor to light at time $t_o$ the applied potential decays by an amount $\Delta V$ in a time $t_f$ at a substantially more rapid rate to a selected potential $V_f$, eventually reaching a residual potential, $V_R$ upon a continuous exposure. The course of decay is shown in FIG. 6 in which the modulator potential is plotted against time.

From the curve it can be seen that the greatest change in potential occurs at the beginning of the light exposure. The amount of light exposure required to produce a given change in potential can be minimized by operating on this steep portion of the curve. This is achieved by applying a bias potential to the ion modulator by means of a supplementary electrode such that the acceptance voltage is higher and the requisite partial light discharge is realized in a very short time.

Figure 7:
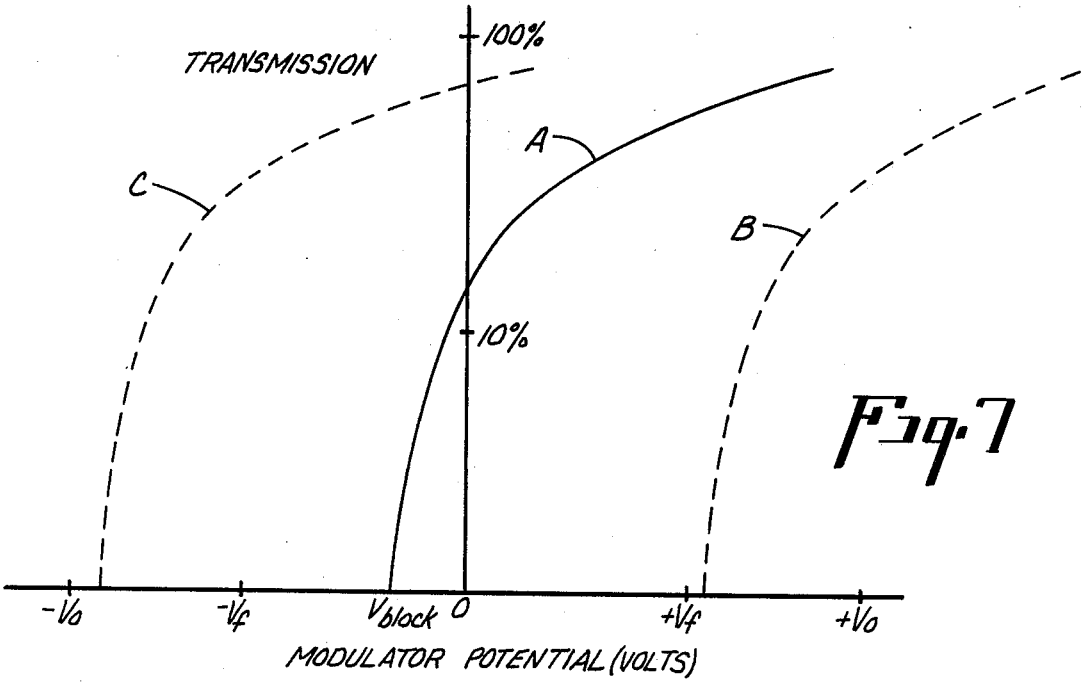
FIG. 7 is a series of ion transmission curves showing the effect of a supplementary electrode used for applying a bias according to this invention.

In addition to the light exposure requirement another problem which must be overcome in providing a suitable ion modulator system is that of background, the solution to which can be best understood by reference to FIG. 7, which shows a series of ion transmission curves representative of the transmission of ions through the ion modulator of this invention. These curves are semi-logarithmic plots of the percent transmission against the modulator potential. The blocking potential, $V_{block}$, is that potential at which no ions are permitted to pass through the apertures of the ion modulator. In FIG. 7, $V_{block}$ is about −20 volts, that is, a negative potential greater than about 20 volts will block ion transmission through the modulator and prevent the production of background in the light portions of the ion modulator. Curve A shows that a modulator potential of about −15 volts results in a transmission of only about 1% whereas a modulator potential of about +80 volts results in a transmission of about 80% if no bias potential is applied. In Curve B the ion transmission curve has been moved to the right and a 1% transmission is achieved at a potential slightly above $V_f$. The ion transmission curve can be effectively moved to the right by applying a positive bias potential to the ion modulator by means of the supplementary electrode. It has been found that a light decay, Δ V of about 20 to 30 volts results in the production of images of the desired quality in the case of line copy and that up to 100 volts can be used to produce images of pictorial copy. It has been found that the background can be reduced to essentially zero by application of a positive bias on the order of 50 to 100 volts during the precharge step and a positive bias of about 10 to 30 volts will be adequate during the projection step in the case of line copy. For pictorial copy a bias potential of about 1 to 30 volts will suffice to obtain the enhanced gray scale desired. What is required is that $$|V_L - V_B| \geqslant |V_{block}|$$

with $V_B > V_L > 0$ and $V_{block} < 0$ where $V_L$ is the modulator potential in the light areas, $V_B$ is the bias potential and $V_{block}$ is the blocking potential. The equation applies for the embodiment shown in FIGS. 2 and 4 and for the projection of negative ions For the embodiment shown in FIGS. 1 and 5 the shielding effect of the photoconductor upon the screen must be taken into consideration by increasing the bias to compensate for the fact that the efficiency, $\eta$ is less than 1.

Where positive ions are projected the modulator, as pointed out above, operates in the negative mode. The relationships to be satisfied in this mode are as follows:

$$V_D - V_B \geqslant V_{block} > 0$$

with $V_D > V_B > 0$ and where $V_D$ is the modulator potential in the dark.

In the embodiment of FIG. 5 the situation is similar as shown by Curve C of FIG. 7. The bias potential is determined in accordance with the following equation:

$$|V_D - V_B| \geqslant |V_{block}|$$

with $V_D < V_B < 0$ and $V_{block} < 0$.

This relationship applies in the case of an electrostatic charge of negative polarity, the application of a negative bias potential and the projection of negative ions, which results in a negative mode of operation.

Where positive ions are projected the modulator, as pointed out above, operates in the positive mode. The relationships to be satisfied in this mode are as follows:

$$V_L - V_B \geqslant V_{block} > 0$$

with $V_B < V_L < 0$.

Other factors which makes this process advantageous are the effects of pagewise homogeneity and increased gray scale which are realized by operating upon a portion of the ion transmission curve which is less steep. This results in pagewise homogeneity because fluctuations in modulator potential have less relative effect upon ion transmission on this portion of the curve. This also results in greater ion transmission and improved image density.

Representative values for the applied negative bias in the case of the negative mode of operation of the ion modulator of this invention are from about −50 volts to −100 volts during precharging and −0.5 volt to −15 volts during ion projection for both line and pictorial copy.

This invention has been described with reference to specific embodiments and to various suggested conditions of operation. However, other embodiments can be utilized in order to achieve the results of the ion modulator and the electrophotographic processes of this invention. It is therefore intended that this invention is not to be limited except as defined in the following claims.

I claim:

1. A process for producing from a graphic original copies displaying pagewise homogeneity and essentially free of background comprising the steps of:

1. applying an electrostatic charge to a photoconductive surface of an ion modulator while applying a large bias potential of the same polarity as that of the charge to said ion modulator,

2. projecting upon said ion modulator a pattern of light and shadow corresponding to said graphic original,

3. projecting ions upon a conductive surface of said ion modulator opposite from said photoconductive surface while applying a bias potential less than said large bias potential to said ion modulator, whereby ions are transmitted through said modulator in a pattern corresponding to said original,

4. creating a latent electrostatic image corresponding to said pattern upon a dielectric surface in the path of said transmitted ions, and

5. developing said latent electrostatic image, said ion modulator being a member selected from the group consisting of (*a*) a conductive screen having a photoconductor coated on at least one side thereof, an electrically insulating layer coated on the other side thereof and a thin metal film applied to said electrically insulating layer (*b*) a conductive screen overcoated with a photoconductive layer, said photoconductive layer being coated on one side thereof with a thin metal film (*c*) a conductive screen having an electrically insulating layer partially coated thereon, a thin metal film coated only on said electrically insulating layer and a photoconductive layer coated only on said metal film and (*d*) a conductive screen having a photoconductive layer partially coated thereon, a thin metal film coated only on said photoconductive layer and a photoconductive layer coated only on said metal film, said bias potentials being applied between said film and said screen during steps of applying an electrostatic charge and projecting ions and being defined by the relationships $$|V_L - V_B| \geqslant |V_{block}|$$

with $V_B > V_L > 0$ and $V_{block} < 0$ and $$|V_D - V_B| \geqslant |V_{block}|$$

with $V_D < V_B < 0$, and $V_{block} < 0$ when said ions are of negative polarity and by the relationships $$V_L - V_B \geqslant V_{block} > 0$$

with $V_B < V_L < 0$ and $$V_D - V_B \geqslant V_{block} > 0$$

with $V_D > V_B > 0$ where $V_L$ is the modulator potential in the light areas, $V_B$ is the bias potential, $V_{block}$ is the blocking potential and $V_D$ is the modulator potential in the dark areas when said ions are of positive polarity.

2. A process according to claim 1 wherein said electrostatic charge is of positive polarity, said bias potential is positive, said ions are of negative polarity and the process operates in the positive mode.

3. A process according to claim 1 wherein said electrostatic charge is of negative polarity, said bias potential is negative, said ions are of negative polarity and the process operates in the negative mode.

4. A process according to claim 1 wherein said electrostatic charge is of positive polarity, said bias potential is positive, said ions are of positive polarity and the process operates in the negative mode.

5. A process according to claim 1 wherein said electrostatic charge is of negative polarity, said bias potential is negative, said ions are of positive polarity and the process operates in the positive mode.

6. An ion modulator comprising a conductive screen having photoconductive layer partially coated thereon, a thin metal film coated only on said photoconductive layer and a photoconductive layer coated only on said metal film.

* * * * *